United States Patent [19]

Takagi

[11] Patent Number: 4,785,998

[45] Date of Patent: Nov. 22, 1988

[54] WATER SPRAYING NOZZLE

[76] Inventor: Toshio Takagi, No. 3-5-1305, Shiragane 1-chome, Kokurakita-ku, Fukuoka-ken, Japan

[21] Appl. No.: 53,968

[22] Filed: May 26, 1987

[30] Foreign Application Priority Data

Jun. 9, 1986 [JP] Japan ..... 61-133152
Sep. 24, 1986 [JP] Japan ..... 61-225461
Mar. 28, 1987 [JP] Japan ..... 62-75366

[51] Int. Cl.[4] ..... B05B 1/16; B05B 1/32

[52] U.S. Cl. ..... 239/440; 239/441; 239/446; 239/449; 74/89.15

[58] Field of Search ..... 239/436–441, 239/443, 444, 446, 448, 449; 74/89.15, 424.8 A

[56] References Cited

U.S. PATENT DOCUMENTS 3,363,434 1/1968 Kuhn et al. ..... 74/89.15
4,265,405 5/1981 Takagi ..... 239/440

FOREIGN PATENT DOCUMENTS 2155817 10/1985 United Kingdom ..... 239/447

*Primary Examiner*—Douglas C. Butler
*Assistant Examiner*—Karen B. Merritt
*Attorney, Agent, or Firm*—Felfe & Lynch

[57] ABSTRACT

A water spraying nozzle of the present invention is constructed of a relatively small number of parts which can be easily assembled to produce the water spraying nozzle at a low cost, which nozzle is easy in handling to enable any user to smoothly operate it without any special training. In the water spraying nozzle of the present invention, the outer and intermediate sleeves employed in the conventional water spraying nozzle are replaced with a novel controlling sleeve comprising an inner and an outer sleeve portions enabling the user to operate the water spraying nozzle in a very simple manner.

5 Claims, 12 Drawing Sheets

WATER SPRAYING NOZZLE

BACKGROUND OF THE INVENTION

1. Field of the Invention:

The present invention relates to a water spraying nozzle.

2. Description of the Prior Art:

As shown in FIG. 1, Japanese Patent Application No. 24644/1979 (Laid-Open No. 116459/1980) filed also by the inventor of the present invention discloses one of conventional water spraying nozzles of this kind.

Such conventional water spraying nozzle is provided with a base sleeve 82 to a rear end of which is threadably connected a hose connecting portion 80. A front end of the base sleeve 82 is closed to form a first valve portion 84 behind which is provided a peripheral wall having a first through-hole 81. The base sleeve 82 is inserted into a nozzle body 83 and threadably connected thereto to make it possible that the base sleeve 82 is axially moved relative to the nozzle body 83 when rotated relative to the same 83. By making such axial movement of the base sleeve 82, the first valve portion 84 of the base sleeve 82 is abutted/separated on/from a first valve seat 95 of the nozzle body 83 to close/open a fluid path formed therebetween.

A front end of the nozzle body 83 is closed to form a second valve portion 89 at a front end portion of which is projectively formed a controlling bar portion 98 behind which is provided a peripheral wall having a second through-hole 87.

A front portion of the nozzle body 83 is inserted into an intermediate sleeve 85 so as to be threadably connected thereto. At a front end of the intermediate sleeve 85 is projectively formed a small sleeve portion 93 provided with a nozzle opening 90 in which the controlling bar portion 98 of the nozzle body 93 is disposed. Behind the small sleeve portion 93 of the intermediate sleeve 85 is provided a peripheral wall having a third through-hole 88. Between such third through-hole 88 and the nozzle opening 90 is formed a third valve portion 91 in the intermediate sleeve 85. In operation, the intermediate sleeve 85 is rotated relative to the nozzle body 83 so as to be axially moved relative to the same 83. By making such axial movement of the intermediate sleeve 85, the second valve portion 89 of the nozzle body 83 is abutted/separated on/from a second valve seat 96 of the intermediate sleeve 85 to close/open a fluid path formed therebetween.

A front portion of the intermediate sleeve 85 is inserted into an outer sleeve 86 so as to be threadably connected thereto. A front end of the outer sleeve 86 is shaped into a funnelform portion having an opening in which is mounted a porous plate 92 having a through-hole 94 in which the small sleeve portion 93 of the intermediate sleeve 85 is slidably inserted. An annular third valve seat 97 of the outer sleeve 86 is formed at a position opposite to the third valve portion 91 of the intermediate sleeve 85. Consequently, when the outer sleeve 86 is rotated relative to the intermediate sleeve 85, the outer sleeve 86 is axially moved relative to the intermediate sleeve 85 so that the third valve portion 91 of the intermediate sleeve 85 is abutted/separated on/from the third valve seat 97 of the outer sleeve 86, whereby a fluid path formed therebetween is closed/opened according to such axial movement of the outer sleeve 86.

In the conventional water spraying nozzle having the above construction, in order to change a water discharging condition or mode thereof, it is necessary to conduct a complex operation such as rotations of: the nozzle body 83 relative to the base sleeve 82; the intermediate sleeve 85 to the nozzle body 83; and the outer sleeve 86 to the intermediate sleeve 85.

Consequently, it is hard for some users to smoothly conduct such operation of the conventional water spraying nozzle. In addition to the above difficulty in use, the conventional water spraying nozzle also suffers from a large material cost and a large labor cost in producing thereof due to a complex assembling process of a large number of parts thereof and complex processes for producing such parts, which makes it impossible to provide the water spraying nozzle at a low cost.

SUMMARY OF THE INVENTION

It is an object of the present invention to provide a water spraying nozzle constructed of a relatively small number of parts which can be easily assembled to produce the water spraying nozzle at a low cost, which nozzle is easy in handling.

In order to accomplish the above object, the present invention provide: In a water spraying nozzle including a tubular nozzle body which is provided with a water inlet at its rear end while closed at its front end, and a controlling sleeve into which said nozzle body is inserted and connected thereto, the improvement wherein: said nozzle body is provided with a first communication hole at its peripheral wall while closed at its front end to projectively form a controlling bar portion behind which is formed a first valve portion, a rear portion of said nozzle body being connected with a rear portion of said controlling sleeve so as to permit them to conduct an axial relative movement therebetween; said controlling sleeve is provided with an inner and an outer sleeve portions at its front portion to form an outer fluid path between said inner and said outer sleeve portions, while between said inner sleeve portion of said controlling sleeve and said peripheral wall of said nozzle body is formed an inner fluid path, said inner sleeve portion of said controlling sleeve being provided with a nozzle opening at its front end and a valve seat provided behind said nozzle opening together with a second communication hole provided at its peripheral wall behind said valve seat, in which nozzle opening is received an expanded head portion of said controlling bar portion of said nozzle body, which valve seat is provided at a position opposite to said first valve portion of said nozzle sleeve, while a second valve portion is provided between an outer peripheral surface of said nozzle body and an inner peripheral surface of said inner sleeve portion of said controlling sleeve; a porous plate is mounted in a front end opening of said controlling sleeve, at least one of said controlling sleeve and said nozzle body being able to travel between a first position and a second position, in which first position said first valve portion of said nozzle body is abutted on said valve seat of said inner sleeve portion of said controlling sleeve to close a fluid path formed therebetween while said second valve portion shuts off a water flow between said first and second communication holes, in which second position said first valve portion of said nozzle body is separated from said valve seat of said inner sleeve portion of said controlling sleeve to open said fluid path formed therebetween while said second valve portion closes a fluid path formed between said first communication hole of said nozzle sleeve and said nozzle opening of said inner sleeve portion of said controlling sleeve, said first communication hole being fully opened together with said second communication hole of said inner sleeve portion of said controlling sleeve so as to be communicated with each other in said second position.

In the water spraying nozzle having the above construction, in case that the controlling sleeve or the nozzle body is located at the first position, a water flow having issued from the hose to the nozzle body of the water spraying nozzle passes through the first communication hole of the nozzle body to enter the inner fluid path defined between the nozzle body and the inner sleeve portion of the controlling sleeve. When the first valve portion of the nozzle body is abutted on the valve seat of the controlling sleeve in the front end portion of the water spraying nozzle, the water flow is shut off between the inner fluid path and the nozzle opening the inner sleeve portion of the controlling sleeve while also shut off between the first and the second communication holes by means of the second valve portion to stop a water spraying through the porous plate.

In case that the controlling sleeve or the nozzle body is located at the second position, since the water flow is shut off between the nozzle opening of the inner sleeve portion of the controlling sleeve and the first communication hole of the nozzle body by means of the second valve portion, a linear water discharging through the nozzle opening stops. At the same time, since the first and the second communication holes are fully opened to communicate with each other, the water flow issued from the hose passes through these communication holes and the outer fluid path defined between the inner and the outer sleeve portions of the controlling sleeve to reach the porous plate provided in the front end of the controlling sleeve, from which porous plate the water flow is issued in showers outward to form a linear water sprinkling.

Consequently, according to the traveling of the controlling sleeve or that of the nozzle body, the water spraying nozzle performs sequentially various water discharging charging modes, i.e., the water spraying through the nozzle opening, the linear water discharging through the nozzle opening, stopping of the linear water discharging and the linear water sprinkling through the porous plate.

In an embodiment of the present invention, a gripping sleeve provided with a hose connecting portion at its rear end is connected to a rear end of the nozzle body which is threadably connected with the controlling sleeve in front of the gripping sleeve, whereby the controlling sleeve is axially traveled or moved relative to the nozzle body so as to permit the water spraying nozzle to perform the various water discharging modes mentioned above in case that the controlling sleeve is operated through the gripping sleeve so as to be rotated relative to the nozzle body.

In another embodiment of the present invention, the gripping sleeve is connected to the rear end of the controlling sleeve which is inserted into a sleeve-like element in front of the gripping sleeve, said sleeve-like element being provided with a spiral groove in its inner surface so as to keep the controlling sleeve not axially movable but rotatable, provided that the controlling sleeve is provided with an axially extending linear slot at a position corresponding to that of the spiral groove of the sleeve-like element and that a pin is provided in a peripheral surface of the nozzle body so as to be brought into a slidable contact with each of the sprial groove and the axially extending linear slot to permit the nozzle body to axially move relative to the controlling sleeve, whereby the various water discharging modes mentioned above are performed by the water spraying nozzle.

In further another embodiment of the present invention, the controlling sleeve is divided into an inner sleeve portion and an outer sleeve portion so that the gripping sleeve is connected to a rear end of the inner sleeve portion in which is formed the axially extending linear slot, while the sleeve-like element in which is provided the spiral groove forms a part of the outer sleeve portion inside the same. In this case, only the inner sleeve portion of the controlling sleeve is kept stationary, while the outer sleeve portion of the controlling sleeve is kept rotatable to permit the nozzle body to axially move, whereby the various water discharging modes mentioned above are performed by the water spraying nozzle.

In a still further another embodiment of the present invention, a threaded sleeve portion having a female screw portion in its inner peripheral surface is integrally connected to a front end of the gripping sleeve, which female screw portion is threadably engaged with a male screw portion formed in a surface of a projecting portion of a peripheral surface of a rear portion of the nozzle body, which projecting portion is brought into a slidable contact with the axially extending linear slot of the controlling sleeve a rear end of which is brought into a slidable contact with a rear end surface of the threaded sleeve portion, whereby, in case that the controlling sleeve is rotated, the nozzle body is also rotated through its projecting portion slidably contacting the axially extending linear slot of the controlling sleeve so that the male screw portion of the projecting portion is axially moved relative to the female screw portion of the threaded sleeve portion while the controlling sleeve is kept stationary to make it possible that the water spraying nozzle performs the various water discharging modes mentioned above.

DESCRIPTION OF THE PREFERRED EMBODIMENTS

Figure 1:
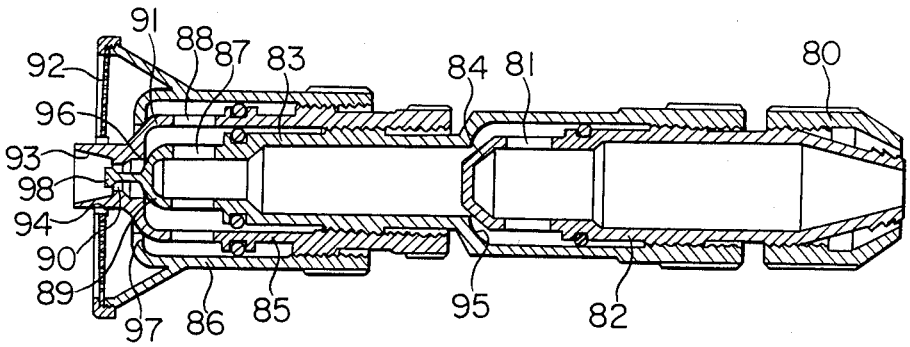
FIG. 1 PRIOR ART
FIG. 1 is a longitudinal sectional view of a typical conventional sample of the water spraying nozzle in the art similar to that of the present invention.

FIGS. 2 to 7 show a first embodiment of the water spraying nozzle of the present invention.

In such first embodiment of the present invention, the reference numeral 1 denotes a tubular connecting portion a front end portion of which is threadably connected with a rear portion of a gripping sleeve 3 to a front end portion of which is connected a rear end portion of a tubular nozzle body 6.

The nozzle body 6 is provided with a first communication hole 5 in its peripheral wall 4 while closed at its front end to form a first valve portion 11 which is projectively provided with a controlling bar portion 10 extending forward form the first valve portion 11 and having an expanded head portion 24. A rear end portion 7 of the nozzle body 6 is threaded to form a male screw in front of which is formed an annular groove in which an O-ring 30 is mounted.

Figure 2:
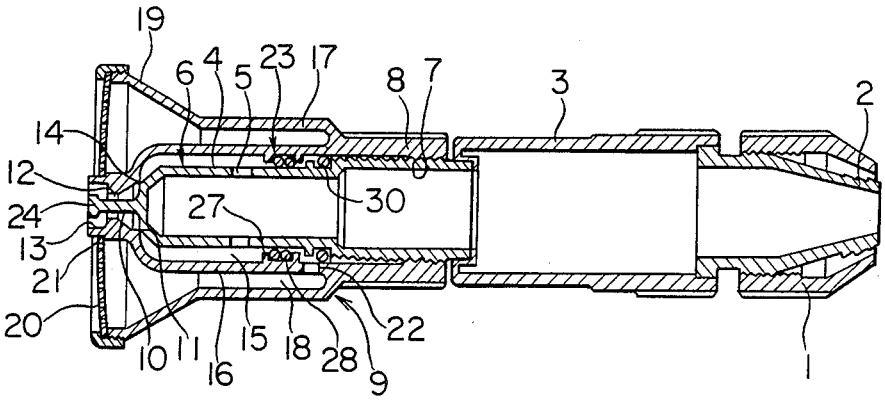
FIG. 2 is a longitudinal sectional view of a first embodiment of the water spraying nozzle of the present invention.

As shown in FIG. 2, the reference numeral 9 denotes a controlling sleeve in which is inserted the nozzle body 9. An operating portion 8 having a female screw is provided in a rear portion of the controlling sleeve 9 and threadably connected through its female screw to a male screw of a rear end portion of the nozzle body 6. In a front portion of the controlling sleeve 9 are formed an inner 16 and an outer 17 sleeve portions between both of which is formed an outer fluid path 18. On the other hand, an inner fluid path 15 is formed between an inner peripheral surface of the inner sleeve portion 16 of the controlling sleeve 9 and an outer peripheral wall 4 of the nozzle body 6. In a front end of the inner sleeve portion 16 is formed a small sleeve portion 13 having a nozzle opening 12 in which is located the expanded head portion 24 of the controlling bar portion 10 of the nozzle body 6. A valve seat 14 is formed in the inner sleeve portion 16 at a position behind the smaller sleeve portion 13 so as to be opposite to the first valve portion 11 of the nozzle body 6. A second communication hole 22 is formed in a peripheral wall of the inner sleeve portion 16 of the controlling sleeve 9 at a position behind that of the first communication hole 5 of the nozzle body 6. As shown in FIG. 2, in a condition in which the first valve portion 11 of the nozzle body 6 is abutted on the valve seat 14 of the controlling sleeve 9 to close the nozzle opening 12 of the small sleeve portion 13 thereof, a second valve portion 23 is formed in the inner fluid path 15 so as to shut off a water flow established between the first 5 and the second 22 communication holes. In such first embodiment of the present invention shown in FIG. 2, the second valve portion 23 is constructed of: a pair of annular flanges 27 projectively provided in the inner peripheral surface of the inner sleeve portion 16 of the controlling sleeve 9; and an O-ring 28 disposed in a position between such annular flanges 27 of the inner sleeve portion 16. At a front end portion of the controlling sleeve 9 is provided a funnel-form sleeve portion 19 diverging forward to provide a divergent opening portion in which is mounted a porous plate 20 having a through-hole 21 in which the small sleeve portion 13 of the controlling sleeve 9 is slidably inserted.

FIG. 2 shows a condition in which the water discharging from the water spraying nozzle of the present invention stops, namely, the first valve portion 11 of the nozzle body 6 is abutted on the valve seat 14 of the controlling sleeve 9 to shut off a water flow at a position between the interior of the nozzle body 6 and the nozzle opening 12 of the small sleeve portion 13, while the second valve portion 23 shuts off a water flow at a position between the first 5 and the second 22 communication holes in the inner fluid path 15.

Figure 3:
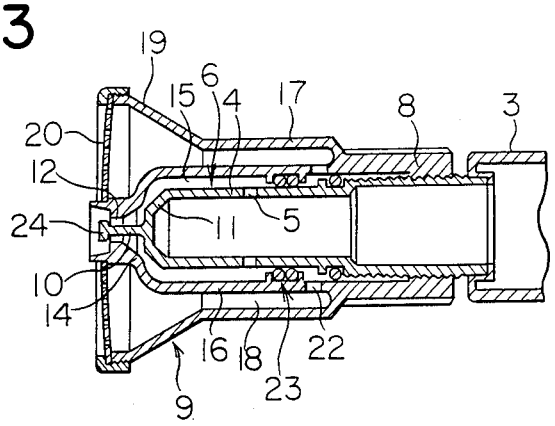
FIG. 3 is a longitudinal sectional view of the first embodiment of the present invention in a condition in which the water is discharged in the form of mist from the water spraying nozzle.

FIG. 3 shows a condition in which the water spraying nozzle of the present invention discharges water in the form of mist. In this case, the user holds the operating portion 8 of the controlling sleeve 9 and rotates the same relative to the nozzle body 6 so as to axially slightly move the controlling sleeve 9 formed relative to the same 6, whereby the first valve portion 11 of the nozzle body 6 is separated from the valve seat 14 of the controlling sleeve 9. As a result, a narrowwidth annular opening is formed around the expanded head portion 24 of the controlling bar portion 10 of the nozzle body 6 to communicate with the nozzle opening 12 of the small sleeve portion 13, while the water flow between the first 5 and the second 22 communication holes is still shut off. Under such circumstances, in case that the water is supplied from a hose (not shown) to the nozzle body 6, the water passes sequentially through the first communication hole 5, inner fluid path 15 and the nozzle opening 12 and is issued from the above-mentioned narrow-width annular opening in the from of mist.

Figure 4:
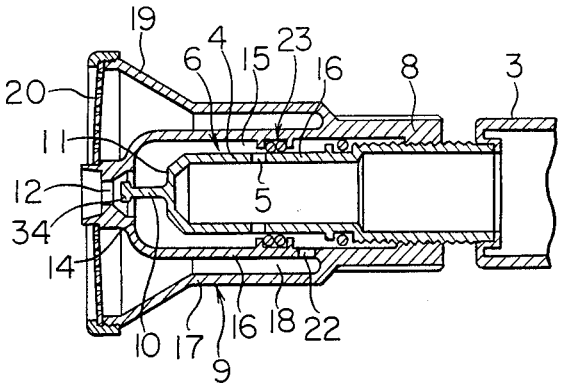
FIG. 4 is a longitudinal sectional view of the first embodiment of the present invention in a condition in which the water is discharged in the form of a single linear water flow.

FIG. 4 shows a condition in which the water spraying nozzle of the first embodiment of the present invention discharges the water in the form of a single linear flow. In this case, the controlling sleeve 9 is further moved forward relative to the nozzle body 6, so that the expanded head portion 24 of the controlling bar portion 10 of the nozzle body 6 is retracted so as to open the nozzle opening 12 to enable a large amount of water to be discharged from the nozzle opening 12, while the water flow between the first 5 and the second 22 communication holes are still shut off, whereby the water is discharged from the nozzle opening 12 in the form of a strong single linear flow.

Figure 5:
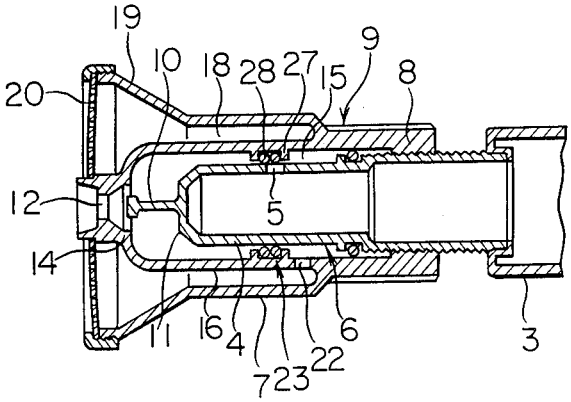
FIG. 5 is a longitduinal sectional view of the first embodiment of the present invention in a condition in which the first communication hole of the nozzle body of the water spraying nozzle is closed.

FIG. 5 shows a condition in which the first communication hole 5 is closed again in the first embodiment of the present invention. In this case, the controlling sleeve 9 is still further moved forward relative to the nozzle body 6. As a result, the first communication hole 5 is closed by the O-ring 28 of the second valve portion 23 to prevent the water inside the nozzle body 6 from flowing out of the same 6.

Figure 6:
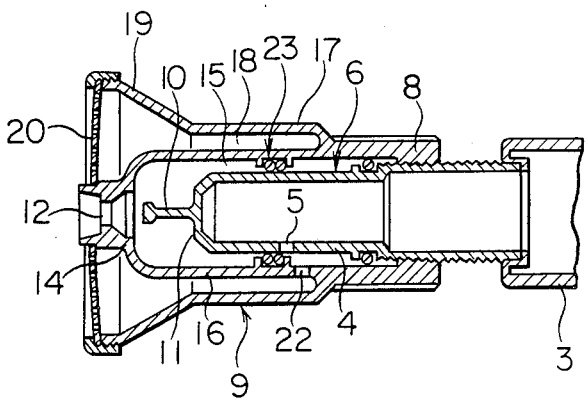
FIG. 6 is a longitudinal sectional view of the first embodiment of the present invention in a condition in which the water is discharged in the form of plurality of weak linear water flows.

FIG. 6 shows a condition in which the water spraying nozzle of the first embodiment of the present invention discharges the water in the form of plurality of linear flows. In this condition, the controlling sleeve 9 is yet further moved forward relative to the nozzle body 6. As a result, in the inner fluid path 15, the second valve portion 23 shuts off the water flow established between the nozzle opening 12 and the first communication hole 5, while a part of the first communication hole 5 communicates with the second communication hole 22. Consequently, the water inside the nozzle body 6 passes through the first 5 and the second 22 communication holes and the outer fluid path 18, and is then discharged from the porous plate 20 in the form of plurality of linear flows as if it is discharged from a conventional watering pot.

Figure 7:
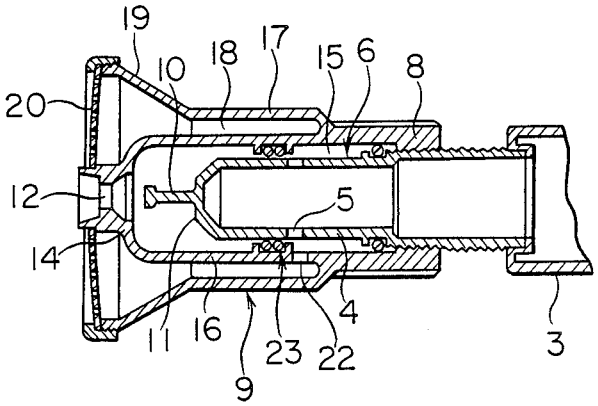
FIG. 7 is a longitudinal sectional view of the first embodiment of the present invention in a condition in which the water is discharged in the form of plurality of strong linear water flows.

FIG. 7 shows a condition in which the water spraying nozzle of the first embodiment of the present invention discharges the water in showers. In this case, the controlling sleeve 9 is moved to its most advanced position relative to the nozzle body 6 to fully open both of the first 5 and the second 22 communication holes so as to permit them to communicate with each other. As a result, a flow rate of the water passing through the outer fluid path 18 increases to permit the porous plate 20 to discharge the water in strong showers through its plurality through-holes.

FIGS. 8 to 13 show a second embodiment of the water spraying nozzle of the present invention, which second embodiment is substantially similar in construction to the first embodiment described above, so that similar reference numerals refer to similar parts throughout the drawings illustrating these embodiment, whereby redundancy in description is eliminated.

Figure 8:
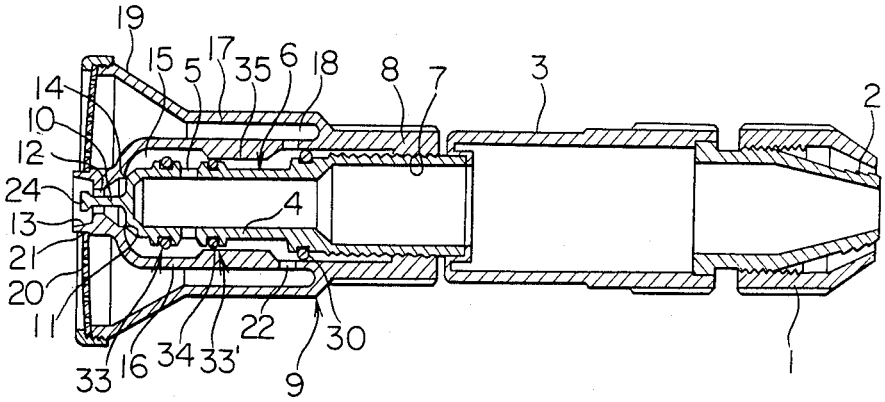
FIG. 8 is a longitudinal sectional view of a second embodiment of the water spraying nozzle of the present invention, similar to FIG. 2.
Figure 9:
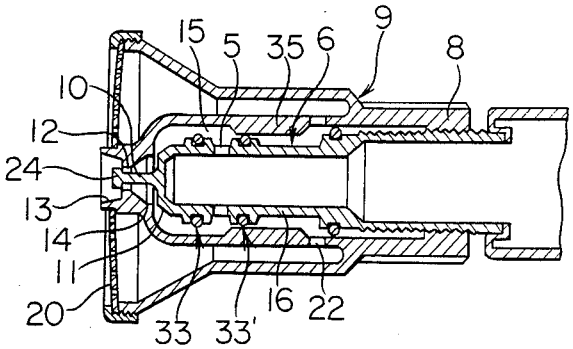
FIG. 9 is a longitudinal sectional view of the second embodiment of the present invention, similar to FIG. 3.
Figure 10:
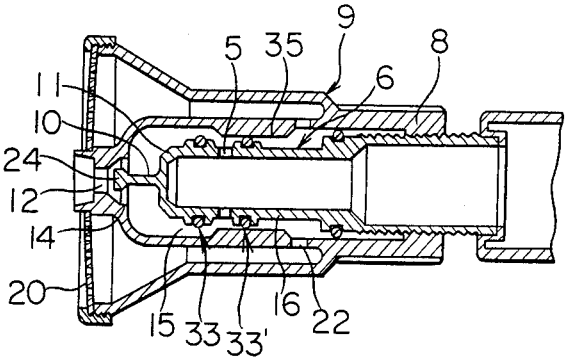
FIG. 10 is a longitudinal sectional view of the second embodiment of the present invention, similar to FIG. 4.
Figure 11:
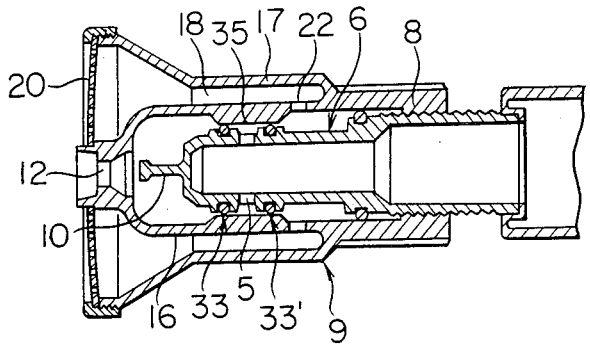
FIG. 11 is a longitudinal sectional view of the second embodiment of the present invention, similar to FIG. 5.
Figure 12:
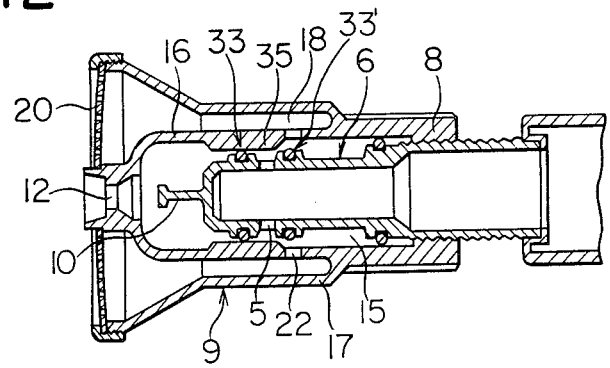
FIG. 12 is a longitudinal sectional view of the second embodiment of the present invention, similar to FIG. 6.
Figure 13:
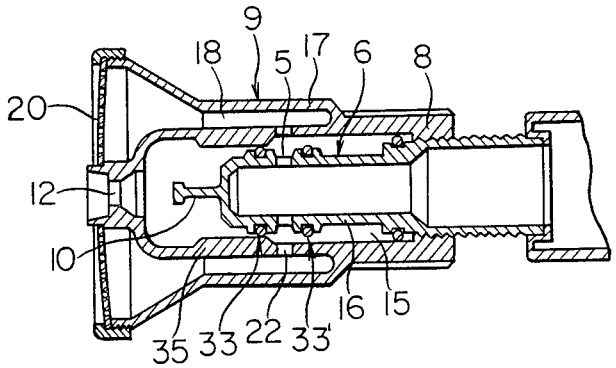
FIG. 13 is a longitudinal sectional view of the second embodiment of the present invention, similar to FIG. 7.

In this second embodiment of the present invention, as shown in FIG. 8 illustrating a condition in which the first valve portion 11 of the nozzle body 6 is abutted on the valve seat 14 of the controlling sleeve 9, a second valve portion corresponding to the second valve portion 23 of the first embodiment of the present invention is constructed of a pair of valve portions 33 and 33' between which is interposed the first communication hole 5. Each of the valve portions 33 and 33' is constructed of a pair of annular flanges and an O-ring 34 disposed between such pair of annular flanges. On the other hand, an annular ridge portion 35 abutting on the O-ring 34 is formed in an inner surface of the inner sleeve portion 16 of the controlling sleeve 9.

The second embodiment of the present invention having the above construction is substantially similar in operation to the first embodiment of the present invention. Namely, as shown in FIG. 8, in case that the first valve portion 11 is abutted on the valve seat 14 as is in the first embodiment shown in FIG. 2, the second valve portion 33' is abutted on the annular ridge portion 35 of the inner sleeve portion 16 so that the water flow is shut off at each of positions between the interior of the nozzle body 6 and the nozzle opening 12 and between the interior of the nozzle body 6 and the second communication hole 22, whereby the water discharging of the water spraying nozzle of the present invention stops. In a condition shown in FIG. 9, the controlling sleeve 9 is operated as is in the first embodiment of the present invention in its condition shown in FIG. 3, so that the narrow-width annular opening is formed around the expanded head portion 24 so as to communicate with the nozzle opening 12, while the second valve portion 33' abuts on the annular ridge portion 35 of the inner sleeve portion 16 to shut off the water flow at a position between the first 5 and the second 22 communication holes, whereby the water spraying nozzle of the second embodiment of the present invention discharges the water in the form of mist through such narrow-width annular opening. In a condition shown in FIG. 10, the controlling sleeve 9 is operated as is in the first embodiment of the present invention in its condition shown in FIG. 4, so that the water flow is shut off at a position between the first 5 and the second 22 communication holes while the narrow-width annular opening is expanded in width so as to permit the nozzle opening 12 to discharge the water in the form of a single linear flow. In a condition shown in FIG. 11, the controlling sleeve 9 is operated as in the first embodiment of the present invention in its condition shown in FIG. 5, so that the first communication hole 5 is disposed between the second valve portions 33 and 33' which abut on the annular ridge portion 35 of the inner sleeve portion 16 to shut off the water flow at each of the positions between the first communication hole 5 and the nozzle opening 12 and between the first 5 and the second 22 communication holes, whereby the water spraying nozzle of the present invention stops its water discharging. In a condition shown in FIG. 12, the controlling sleeve 9 is operated as is in the first embodiment of the present invention in its condition shown in FIG. 6, so that the second valve portion 33 abuts on the annular ridge portion 35 of the inner sleeve portion 16 to shut off the water flow at a position between the the first communication hole 5 and the nozzle opening 12, while the water passing through the first communication hole 5 is permitted to flow to the second communication hole 22 through a fluid path restricted by the annular ridge portion 35 of the inner sleeve portion 16, so that the water thus having reached the second communication hole 22 enters the outer fluid path 18 through which the water reaches a plurality of through-holes of the porous plate 20 and is discharged in the form of plurality of linear flows therefrom. In a condition shown in FIG. 13, the controlling sleeve 9 is operated as is in the first embodiment of the present invention in its condition shown in FIG. 7, so that the water flow is still shut off at the position between the first communication hole 5 and the nozzle opening 12, while both of the first 5 and the second 22 communication holes are fully opened so as to permit the porous plate 20 to discharge the water in showers through its plurality of the through-holes.

FIGS. 14 to 21 show a third embodiment of the water spraying nozzle of the present invention, which third embodiment is substantially similar in construction to the first embodiment of the present invention described above, so that similar reference numerals refer to similar part throughout the drawings illustrating these embodiment, whereby redundancy in description is eliminated.

Figure 14:
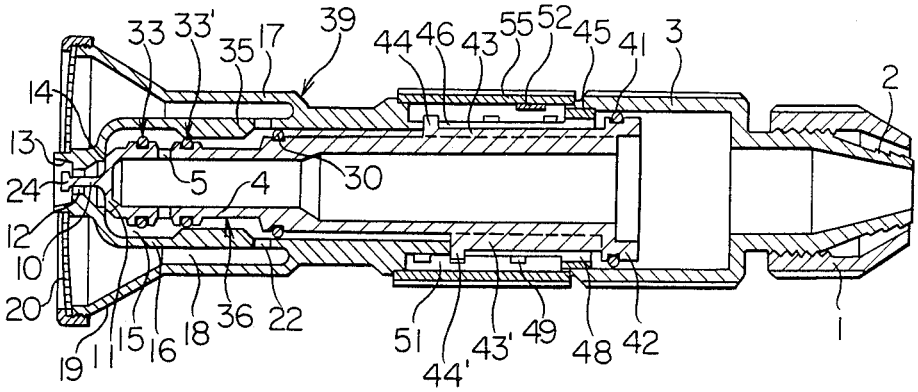
FIG. 14 is a longitudinal sectional view of a third embodiment of the water spraying nozzle of the present invention, similar to FIG. 2.
Figure 15:
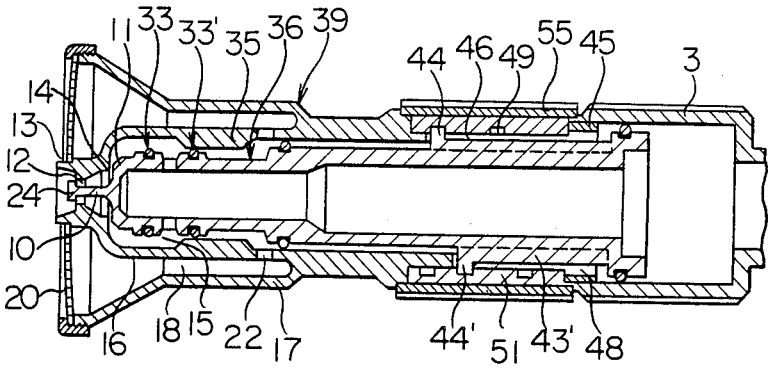
FIG. 15 is a longitudinal sectional view of the third embodiment of the present invention, similar to FIG. 3.
Figure 16:
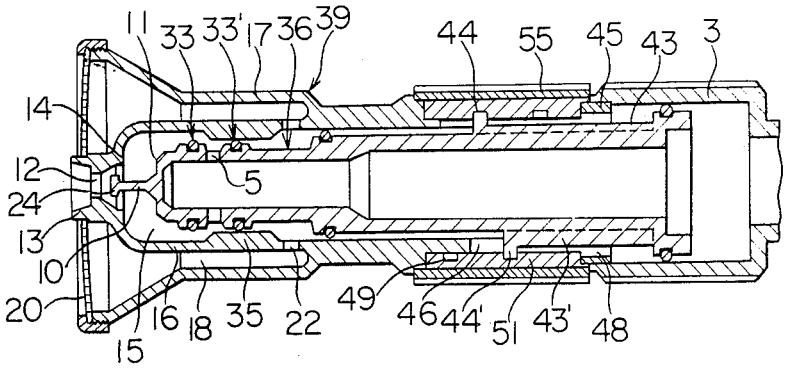
FIG. 16 is a longitudinal sectional view of the third embodiment of the present invention, similar to FIG. 4.
Figure 17:
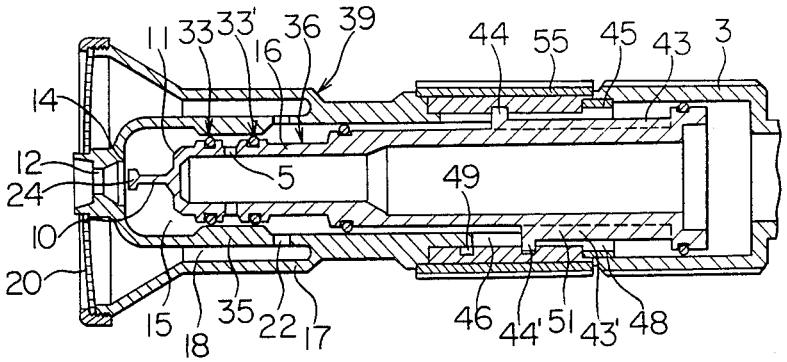
FIG. 17 is a longitudinal sectional view of the third embodiment of the present invention, similar to FIG. 5.
Figure 18:
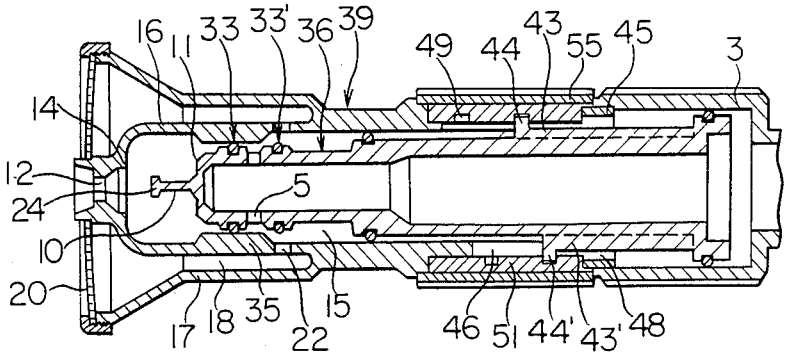
FIG. 18 is a longitudinal sectional view of the third embodiment of the present invention, similar to FIG. 6.
Figure 19:
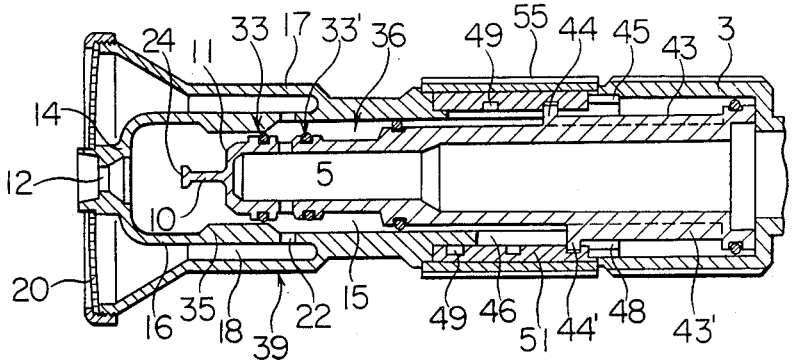
FIG. 19 is a longitudinal sectional view of the third embodiment of the present invention, similar to FIG. 7.

In each of the first and the second embodiments of the present invention described above, although the nozzle body 6 and the controlling sleeve 9 are threadably connected with each other at their rear end portions so as to permit the controlling sleeve 9 to axially move relative to the nozzle body 6 for changing the water discharging modes thereof, the third embodiment of the present invention shown in FIG. 14 is different in construction from these first and second embodiments of the present invention in that the nozzle body 36 is axially moved relative to the controlling sleeve 39 held stationary in contrast with the first and the second embodiment of the present invention.

As shown in FIG. 14, in the third embodiment of the present invention, the nozzle body 36 is extended into an inside of the gripping sleeve 3 at its rear end portion which forms a large-diameter flange portion 42 in which is fixedly mounted an O-ring 41 which is brought into a slidable contact with an inner surface of the gripping sleeve 3 so as to be axially movable. In the nozzle body 36, in front of the large-diameter flange portion 42 are provided a long 43 and a short 43' ridge portions which are diametrically opposite to each other and axially extend, while pins 44 and 44' are provided in front of the long 43 and the short 43' ridge portions, respectively.

Figure 20:
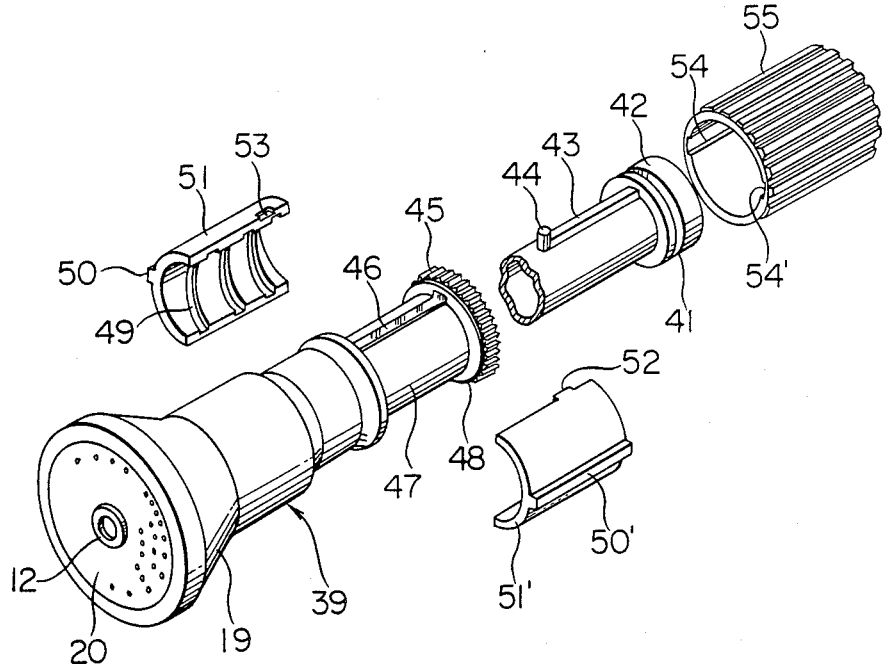
FIG. 20 a perspective, partially broken and exploded view of the third embodiment of the present invention.

In the third embodiment of the present invention, the controlling sleeve 39 is also extended rearward at its rear end portion which forms a large-diameter flange portion 48 as is clearly shown in FIG. 20. In a peripheral portion of such large-diameter flange portion 48 of the controlling sleeve 39 is formed a serrated portion 45 in front of which is formed a small-diameter portion 47 in an outer peripheral wall of which are formed a pair of slots 46 which are diametrically opposite to each other while axially extended forward from the large-diameter flange portion 48. In these slots 46 are inserted the pins 44 and 44' of the nozzle body 36. As clearly shown in FIG. 20, a pair of semicylindrical members 51 and 51' are assembled to form a cylindrical member 51, 51' provided with a pair of diametrically opposite ridges 50 and 50' in its outer peripheral surface and a spiral groove 49 in its inner peripheral surface, which ridges 50 and 50' extend axially in parallel to each other, while the spiral groove 49 receives the pins 44 and 44' provided in the front ends of the ridge portions 43 and 43' of the nozzle body 36, respectively. In assembling of the semicylindrical members 51 and 51', a convex portion 52 of the semicylindrical member 51' is inserted into a concave portion 53 of the semicylindrical member 51 to precisely position these members 51 and 51' relative to each other. The small-diameter portion 47 of the controlling sleeve 39 is received in the cylindrical member 51, 51'. The ridges 50 and 50' of the cylindrical member 51, 51' are received in a pair of slots 54 and 54' of an operating sleeve 55, respectively.

In assembling of the third embodiment of the present invention having the above construction, the nozzle body 36 is inserted into the controlling sleeve 39 from the rear end of the same 39 so that the pins 44 and 44' of the nozzle body 36 are inserted into the diametrically opposite slots 46 of the controlling sleeve 39. After that, the semicylindrical members 51 and 51' are assembled around the small-diameter portion 47 of the controlling sleeve 39 so that the thus assembled cylindrical member 51, 51' receives the small-diameter portin 47 therein, whereby the pins 44 and 44' of the nozzle body 36 are received in the spiral groove 49 of the cylindrical member 51, 51'. Then, the ridges 50 and 50' of the cylindrical member 51, 51' are inserted into the slots 54 and 54' of the operating sleeve 55 so that the thus assembled cylindrical member 51, 51' is inserted into the operating sleeve 55, whereby the serrated portion 45 of the large-diameter portion 48 of the controlling sleeve 39 is meshed with a serrated portion of the gripping sleeve 3 as shown in FIG. 14.

In operation of this third embodiment of the present invention shown in FIGS. 14 to 21, the gripping sleeve 3 is held stationary while the operating sleeve 55 is rotated relative to the gripping sleeve 3. As a result, the controlling sleeve 39 is also held stationary since the serrated portion 45 of the controlling sleeve 39 is meshed with that of the gripping sleeve 3.

On the other hand, the cylindrical member 51, 51' is rotated according to the rotation of the operating sleeve 55, since the ridges 50 and 50' of the cylindrical member 51, 51' are engaged with the slots 54 and 54' of the operating sleeve 55 in an insertion manner, respectively. In this case, since the pins 44 and 44' of the nozzle body 36 are engaged with the the spiral groove 49 of the cylindrical member 51, 51' while also engaged with the slots 46 of the controlling sleeve 39, the pins 44 and 44' are axially moved in the slots 46 so as to axially move the nozzle body 36 relative to the controlling sleeve 39.

Through the above operation, as is clear from FIGS. 14 to 19, the water spraying nozzle of the third embodiment of the present invention can discharge the water in the same modes as those performed in the above-mentioned second embodiment of the present invention shown in FIGS. 8 to 13, so that the description of the water discharging modes of the third embodiment of the present invention are eliminated to eliminate redundancy in description.

Figure 21:
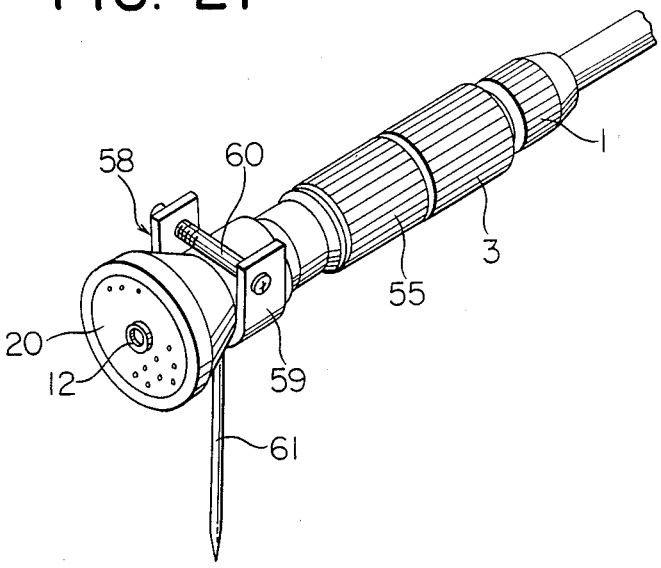
FIG. 21 is a perspective view of the third embodiment of the present invention in one of applications in use.
Figure 22:
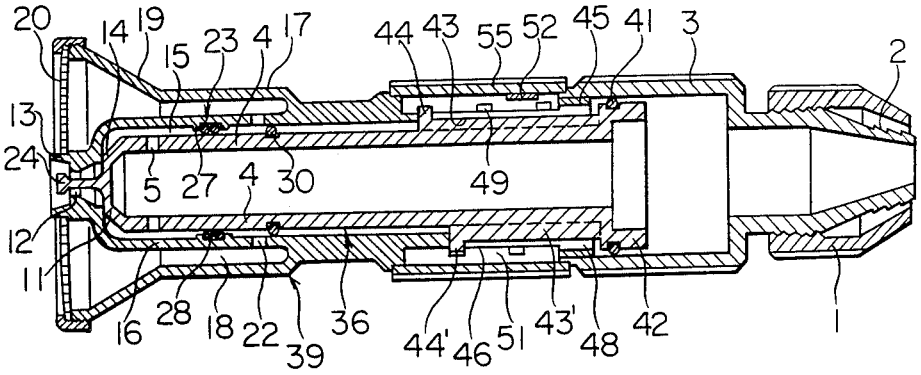
FIG. 22 is a longitudinal sectional view of a fourth embodiment of the water spraying nozzle of the present invention, similar to FIG. 2.
Figure 23:
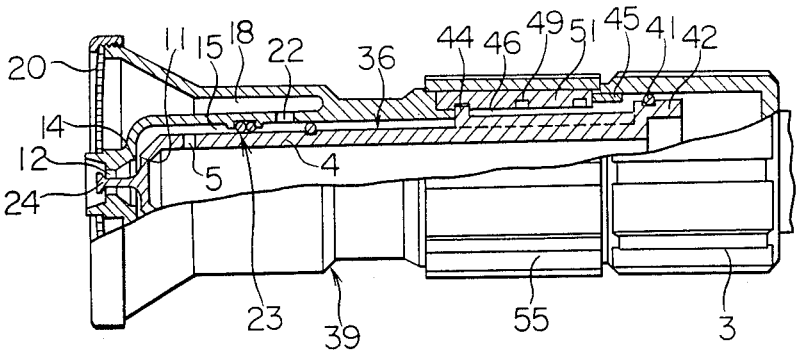
FIG. 23 is a longitudinal sectional view of the fourth embodiment of the present invention, similar to FIG. 3.
Figure 24:
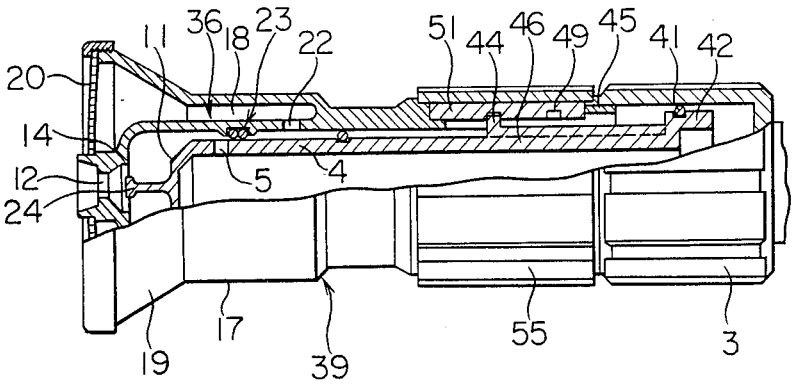
FIG. 24 is a longitudinal sectional view of the fourth embodiment of the present invention, similar to FIG. 4.
Figure 25:
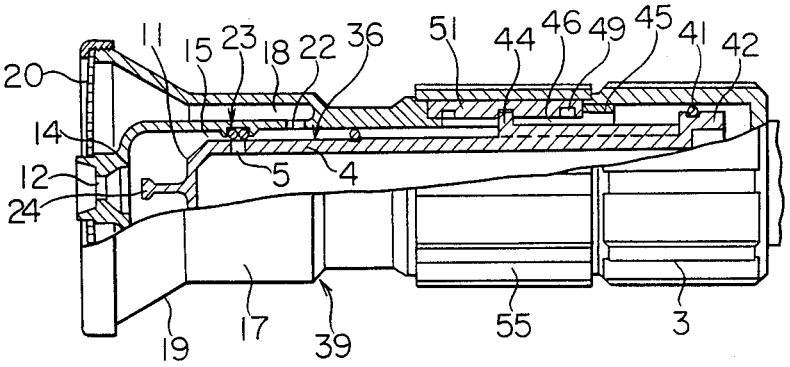
FIG. 25 is a longitudinal sectional view of the fourth embodiment of the present invention, similar to FIG. 5.
Figure 26:
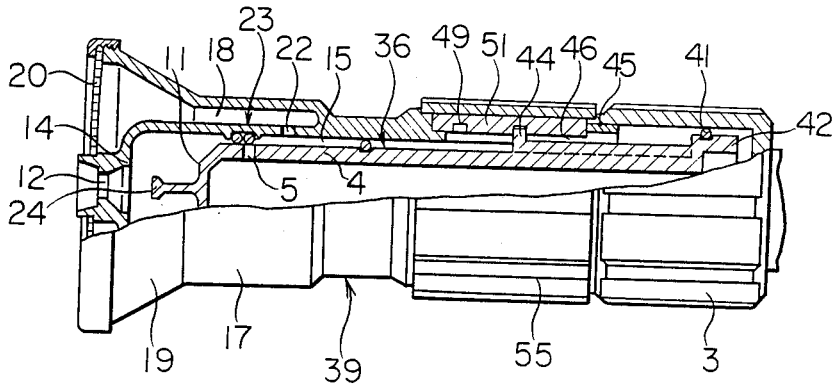
FIG. 26 is a longitudinal sectional view of the fourth embodiment of the present invention, similar to FIG. 6.
Figure 27:
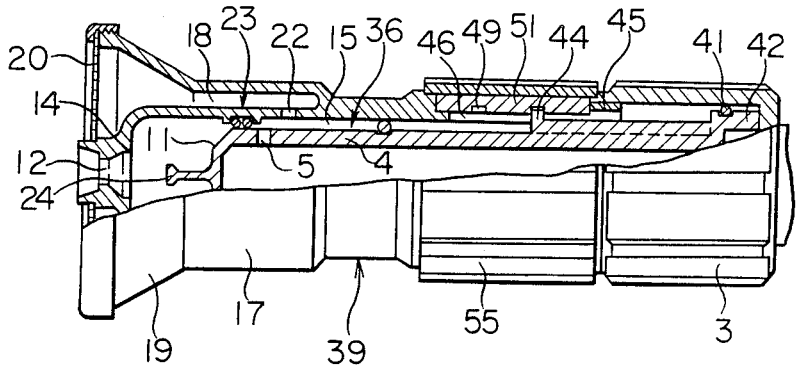
FIG. 27 is a longitudinal sectional view of the fourth embodiment of the present invention, similar to FIG. 7.

FIG. 21 shows a condition in which the water spraying nozzle of the third embodiment of the present invention is coupled with its mount 58 in use. The mount 58 is provided with a U-shaped bar 59 having a bolt 60 in its upper portion and a leg bar 61 in its lower portion. In use, as shown in FIG. 21, the controlling sleeve 39 of the third embodiment of the present invention is received in the U-shaped bar 59 of the mount 58 and fixed therein by means of the bolt 60, while the leg bar 61 of the mount 58 is sticked into the ground.

FIGS. 22 to 27 show a fourth embodiment of the water spraying nozzle of the present invention, which fourth embodiment is similar in construction to the third embodiment of the present invention except that the second valve portion 23 thereof is the same in construction as that of the first embodiment of the present invention, so that like reference numerals identify like parts throughout the drawings. In addition, as for the water discharging modes, there is no difference between the third and the fourth embodiments of the present invention, so that the description of the water discharging modes of the fourth embodiment of the present invention is eliminated to eliminate redundancy in description.

Figure 28:
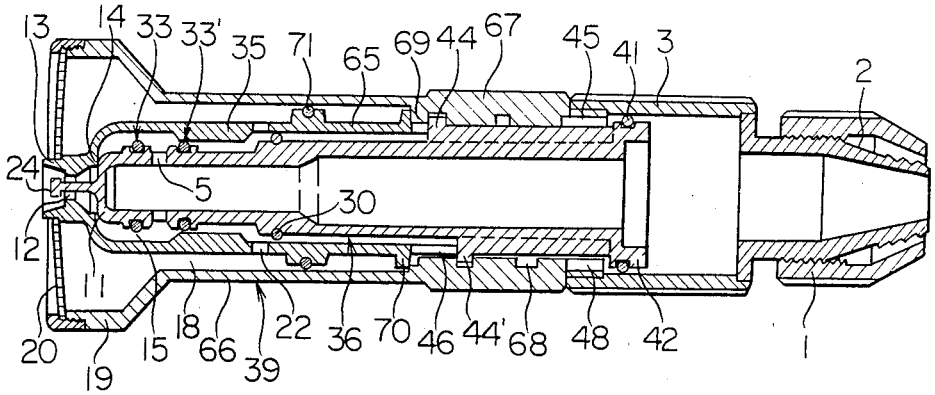
FIG. 28 is a longitudinal sectional view of a fifth embodiment of the water spraying nozzle of the present invention.

FIG. 28 shows a fifth embodiment of the water spraying nozzle of the present invention, which fifth embodiment is similar in construction to the third embodiment of the present invention as to the nozzle body 36 while different in construction from any one of the foregoing embodiments of the present invention as to the controlling sleeve 39. As shown in FIG. 28, in the fifth embodiment of the present invention, the controlling sleeve 39 is divided into an inner 65 and an outer 66 sleeve portions which are similar in partial construction to the controlling sleeve 9 of the second embodiment of the present invention shown in FIGS. 8 to 13 so that like reference numerals identify like parts throughout these drawings in order to eliminate redundancy in description. Consequently, hereinbelow, only the differences in construction between these embodiments of the present invention will be described.

In the fifth embodiment of the present invention, as shown in FIG. 28, a rear end surface of the outer sleeve portion 66 of the controlling sleeve 39 is brought into a slidable contact with a front end surface of the gripping sleeve 3 in front of which the operating sleeve portion 67 is integrally formed with the outer sleeve portion 66 of the controlling sleeve 39. In an inner peripheral surface of the operating sleeve portion 67 is formed a spiral groove 68 in which the pins 44 and 44' of the nozzle body 36 are received in the same manner as that of the third embodiment of the present invention shown in FIGS. 14 to 21. In the inner surface of the operating sleeve portion 67, there is provided a projecting portion 69 in front of the spiral groove 68.

In a rear end portion of the inner sleeve portion 65 of the controlling sleeve 39, there are formed the large-diameter flange portion 48 and the slots 46 both of which are formed in the same manner as those of the third embodiment of the present invention, so that the large-diameter portion 48 of the inner sleeve portion 65 is integrally engaged with the gripping sleeve 3 through its serrated portion 45 engaging with the serrated portion of the gripping sleeve 3. In addition, the inner sleeve portion 65 of the controlling sleeve 39 is provided with an annular flange 70 at a position in front of the slots 46, which flange 70 is brought into a slidable contact with the projecting portion 69 of the operating sleeve portion 67 of the controlling sleeve 39. An O-ring 71 is mounted in an outer peripheral surface of the inner sleeve portion 65 at a position in front of the annular flange 70 so as to be brought into a slidable contact with an inner peripheral surface of the outer sleeve portion 66 of the controlling sleeve 39.

In operation of this fifth embodiment of the present invention shown in FIG. 28, when the operating sleeve portion 67 of the controlling sleeve 39 is rotated, the nozzle body 36 is axially moved relative to the inner sleeve portion 65 of the controlling sleeve 39 in the same manner as that of the third embodiment of the present invention, while the outer sleeve portion 66 of the controlling sleeve 39 is rotated together with the operating sleeve portion 67 thereof relative to the inner sleeve portion 65 of the controlling sleeve 39 in a manner different from that of the third embodiment of the present invention. However, since there is no difference in water discharging modes between the fifth and third embodiments of the present invention, the water discharging modes of the fifth embodiment of the present invention is eliminated to eliminate redundancy in description.

Figure 29:
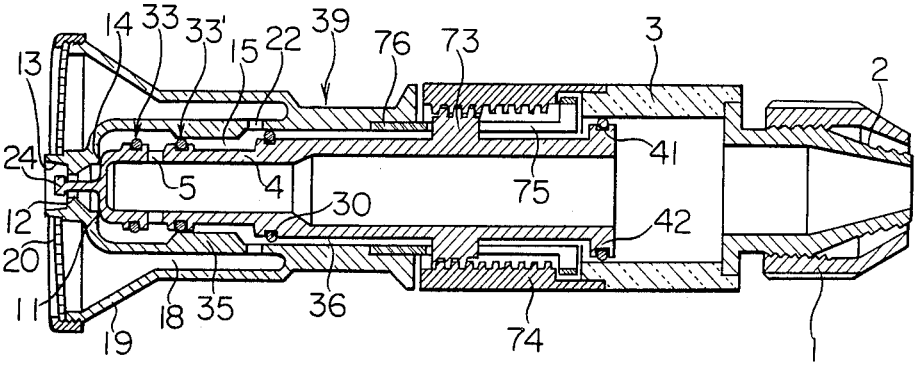
FIG. 29 is a longitudinal sectional veiw of a sixth embodiment of the water spraying nozzle of the present invention.

FIG. 29 shows a sixth embodiment of the water spraying nozzle of the present invention, which sixth embodiment is the substantially same in construction as that of the third embodiment of the present invention shown in FIGS. 14 to 21 so that like reference numerals identify like parts throughout the drawings in order to eliminate redundancy in description.

In this sixth embodiment of the present invention shown in FIG. 29, in place of the pins 44 and 44' of the third and the fourth embodiments of the present invention, a pair of projecting portions 73 having male screw portions are provided in a rear portion of the nozzle body 36, which male screw portions are meshed with a female screw portion of a threaded sleeve portion 74 fixedly mounted in a front end portion of the gripping sleeve 3. The projecting portions 73 of the nozzle body 36 are slidably received in the axially-extending slots 75 of the controlling sleeve 39, which slots 75 are provided in a rear end portion or a guide sleeve porton 76 of the controlling sleeve 39. A rear end portion of the guide sleeve portion 76 of the controlling sleeve 39 is expanded outward to form a flange portion which is brought into a slidable contact with a rear end surface of the threaded sleeve portion 74.

In operation of this sixth embodiment of the present invention shown in FIG. 29, when the controlling sleeve 39 is rotated relative to the gripping sleeve 3, the nozzle body 36 is rotated together with the controlling sleeve 39 while axially moved relative to the controlling sleeve 39, in which the sixth embodiment of the present invention shown in FIG. 29 is different from any one of the foregoing embodiment of the present invention. However, since there is no difference in water discharging modes between the sixth and the foregoing embodiments of the present invention, the description of the water discharging modes of the sixth embodiment of the present invention are eliminated to eliminate redundancy in description.

Although the preferred embodiments of the water spraying nozzle of the present invention has been described in detail in the above for illustrative purposes, it will be recognized that variations or modifications of the preferred embodiments, including the rearrangement of parts, lie within the scope of the present invention.

What is claimed is:

1. In a water spraying nozzle including a tubular nozzle body which is provided with a water inlet at its rear end while closed at its front end, and a controlling sleeve into which said nozzle body is inserted and connected thereto, the improvement wherein: said nozzle body is provided with a first communication hole at its peripheral wall while closed at its front end to projectively form a controlling bar portion behind which is formed a first valve portion, a rear portion of said nozzle body being connected with a rear portion of said controlling sleeve so as to permit them to conduct an axial relative movement therebetween; said controlling sleeve is provided with an inner and an outer sleeve portions at its front portion to form an outer fluid path between said inner and said outer sleeve portions, while between said inner sleeve portion of said controlling sleeve and said peripheral wall of said nozzle body is formed an inner fluid path, said inner sleeve portion of said controlling sleeve being provided with a nozzle opening at its front end and a valve seat provided behind said nozzle opening together with a second communication hole provided at its peripheral wall behind said valve seat, in which nozzle opening is received an expanded head portion of said controlling bar portion of said nozzle body, which valve seat is provided at a position opposite to said first valve portion of said nozzle sleeve, while a second valve portion is provided between an outer peripheral surface of said nozzle body and an inner peripheral surface of said inner sleeve portion of said controlling sleeve; a porous plate is mounted in a front end opening of said controling sleeve, at least one of said controlling sleeve and said nozzle body being able to travel between a first position and a second position, in which first position said first valve portion of said nozzle body is abutted on said valve seat of said inner sleeve portion of said controlling sleeve to close a fluid path formed therebetween while said second valve portion shuts off a water flow between said first and second communication holes, in which second position said first valve portion of said nozzle body is separated from said valve seat of said inner sleeve portion of said controlled sleeve to open said fluid path formed therebetween while said second valve portion closes a fluid path formed between said first communication hole of said nozzle sleeve and said nozzle opening of said inner sleeve portion of said controlling sleeve, said first communication hole being fully opened together with said second communication hole of said inner sleeve portion of said controlling sleeve so as to be communicated with each other in said second position; a gripping sleeve is connected to the rear end of said controlling sleeve which is inserted into a sleeve-like element in front of said gripping sleeve, said sleeve-like element being provided with a spiral groove in its inner surface so as to keep said controlling sleeve not axially movable but rotatable, provided that said controlling sleeve is provided with an axially extending linear slot at a position corresponding to that of said spiral groove of said sleeve-like element and that a pin is provided in a peripheral surface of said nozzle body so as to be brought into a slidable contact with each of said spiral groove and said axially extending linear slot to permit said nozzle body to axially move relative to said controlling sleeve.

2. The water spraying nozzle as set forth in claim 1, wherein: said controlling sleeve is divided into an inner sleeve portion and an outer sleeve portion so that said gripping sleeve is connected to a rear end of said inner sleeve portion in which is formed said axially extending linear slot, while said sleevelike element in which is provided said spiral groove forms a part of said outer sleeve portion inside the same.

3. The water spraying nozzle as set forth in claim 1, wherein: a threaded sleeve portion having a female screw portion in its inner peripheral surface is integrally connected to a front end of said gripping sleeve, said female screw portion being threadably engaged with a male screw portion formed in a surface of a projecting portion of a peripheral surface of a rear portion of said nozzle body, said projecting portion being brought into a slidable contact with said axially extending linear slot of said controlling sleeve a rear end of which is brought into a slidable contact with a rear end surface of said threaded sleeve portion.

4. The water spraying nozzle as set forth in any one of claims 1 to 3, wherein: said second valve portion is provided at a position between a pair of annular flanges formed in an inner surface of said inner sleeve portion; and an O-ring is provided to be brought into a slidable contact with an outer peripheral surface of said nozzle body.

5. The water spraying nozzle as set forth in claim 3, wherein: said second valve portion comprises a pair of O-rings and an annular ridge portion formed in an inner peripheral surface of said inner sleeve portion so as to be brought into a slidable contact with said pair of O-rings mounted in an outer peripheral surface of said nozzle body.

* * * * *